US010994963B2

(12) United States Patent
Okada et al.

(10) Patent No.: US 10,994,963 B2
(45) Date of Patent: May 4, 2021

(54) SHEET POST-PROCESSING DEVICE AND IMAGE FORMING SYSTEM INCLUDING SAME

(71) Applicant: KYOCERA Document Solutions Inc., Osaka (JP)

(72) Inventors: Rina Okada, Osaka (JP); Masahiko Miyazaki, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/942,409

(22) Filed: Jul. 29, 2020

(65) Prior Publication Data

US 2021/0032066 A1 Feb. 4, 2021

(30) Foreign Application Priority Data

Aug. 2, 2019 (JP) ..... JP2019-142789

(51) Int. Cl.
*B65H 9/10* (2006.01)
*B65H 37/04* (2006.01)
(Continued)

(52) U.S. Cl.
CPC ..... *B65H 37/04* (2013.01); *B31F 1/07* (2013.01); *B31F 5/02* (2013.01); *B65H 9/04* (2013.01);
(Continued)

(58) Field of Classification Search
CPC ..... B31F 1/07; B31F 5/02; B31F 2201/07; B31F 2201/0707; B31F 2201/0754; B65H 9/04; B65H 9/06; B65H 9/10; B65H 9/101; B65H 37/04; B65H 2301/43828; B65H 2301/51616; B65H 2408/121; B65H 2408/122; B65H 2408/1222; G03G 2215/00852
(Continued)

(56) References Cited

U.S. PATENT DOCUMENTS 6,126,163 A * 10/2000 Katsuta ..... G03G 15/50 270/58.08
6,168,154 B1 * 1/2001 Asahara ..... B42C 1/12 270/58.12
(Continued)

FOREIGN PATENT DOCUMENTS

JP 2014-076902 A 5/2014

*Primary Examiner* — Leslie A Nicholson, III
(74) *Attorney, Agent, or Firm* — Stein IP, LLC

(57) ABSTRACT

A sheet post-processing device includes: an alignment member which aligns a sheet bundle on a stacking tray; and a stapler which performs binding processing on a rear end of the sheet bundle. The stapler includes: a first stapler which moves along the rear end of a first sheet bundle and performs the binding processing on a plurality of positions at the rear end of the first sheet bundle; and a second stapler which performs, at one part of an end portion of the rear end on one side, binding processing different from the first stapler. The alignment member includes: a first alignment member and a second alignment member which align the sheet bundle in a first stacking position; and a third alignment member which is fixed to a position corresponding to the second stapler and which aligns the sheet bundle in a second stacking position with the first alignment member.

10 Claims, 8 Drawing Sheets

(51) Int. Cl.

| | |
|---|---|
| ***B65H 9/06*** | (2006.01) |
| ***B31F 1/07*** | (2006.01) |
| ***B31F 5/02*** | (2006.01) |
| ***B65H 9/04*** | (2006.01) |

(52) U.S. Cl.
CPC ..... *B65H 9/06* (2013.01); *B65H 9/10* (2013.01); *B65H 9/101* (2013.01); *B31F 2201/07* (2013.01); *B31F 2201/0707* (2013.01); *B31F 2201/0754* (2019.01); *B65H 2301/43828* (2013.01); *B65H 2301/51616* (2013.01); *B65H 2408/121* (2013.01); *B65H 2408/122* (2013.01); *B65H 2408/1222* (2013.01); *G03G 2215/00852* (2013.01)

(58) Field of Classification Search
USPC ..... 270/58.08, 58.12, 58.17
See application file for complete search history.

(56) References Cited

U.S. PATENT DOCUMENTS

| | | | | |
|---|---|---|---|---|
| 6,382,615 | B1 * | 5/2002 | Ishiguro | B65H 31/34 270/58.12 |
| 8,899,569 | B2 * | 12/2014 | Soga | B65H 29/52 270/58.17 |
| 2014/0077437 | A1 | 3/2014 | Abe et al. | 270/58.12 |
| 2015/0266694 | A1 | 9/2015 | Abe et al. | B65H 37/04 |
| 2018/0141776 | A1 | 5/2018 | Abe et al. | B65H 37/04 |
| 2018/0312364 | A1 | 11/2018 | Abe et al. | B65H 37/04 |
| 2020/0071117 | A1 | 3/2020 | Abe et al. | B65H 37/04 |

* cited by examiner

SHEET POST-PROCESSING DEVICE AND IMAGE FORMING SYSTEM INCLUDING SAME

INCORPORATION BY REFERENCE

This application is based upon and claims the benefit of priority from the corresponding Japanese Patent Application No. 2019-142789 filed on Aug. 2, 2019, the entire contents of which are incorporated herein by reference.

BACKGROUND

The present disclosure relates to a sheet post-processing device that stacks, on a stacking tray, sheets such as a paper sheet on which images are formed with an image forming apparatus such as a copying machine or a printer so as to perform binding processing, and to an image forming system that includes such a sheet post-processing device.

Conventionally, a sheet post-processing device is proposed that performs post-processing on a sheet on which an image is formed with an image forming apparatus. Examples of the post-processing described above include punch-hole formation processing which punches punch holes (perforations) in a sheet after image formation and binding processing which stacks a plurality of sheets described above and which binds the sheets with a stapler.

Incidentally, in recent years, a sheet post-processing device has been proposed in which a first stapler for using needles to perform binding processing and a second stapler for performing binding processing without use of needles are provided together. In the sheet post-processing device as described above, the first stapler and the second stapler for performing different types of binding processing differ from each other in the width (height) in an up/down direction of an entrance through which a sheet bundle is inserted and in the maximum number of sheets bound (the maximum thickness of the sheet bundle) which allows the binding processing to be performed. For example, the entrance of the second stapler is narrower in the up/down direction than that of the first stapler. The maximum thickness of the sheet bundle (hereinafter also referred to as the second sheet bundle) which can be bound with the second stapler is smaller than the maximum thickness of the sheet bundle (hereinafter also referred to as the first sheet bundle) which can be bound with the first stapler.

Hence, in a case where the first sheet bundle is bound with the first stapler, when the second stapler is present in a position close to the first sheet bundle, the first sheet bundle interferes with the second stapler. Consequently, the first sheet bundle cannot be arranged in the position of the binding processing using the first stapler. Hence, the second stapler is generally arranged in such a position (position outside the first sheet bundle) that the second stapler does not interfere with the first sheet bundle when the first sheet bundle is bound with the first stapler. Therefore, when the second sheet bundle is bound with the second stapler, the second sheet bundle needs to be moved from the position of the first sheet bundle which is bound with the first stapler to the position for the entrance of the second stapler.

In this respect, the following technology is known. Specifically, on a stacking tray, a sheet bundle is sandwiched between a first alignment member and a second alignment member, and thus the sheet bundle is located. Depending on when a first sheet bundle is bound with a first stapler which is moved to a plurality of parts in a sheet width direction (direction along a sheet rear end) or when one part of a second sheet bundle is bound with a second stapler which is not moved, the two alignment members (the first alignment member and the second alignment member) for locating the sheet bundle are individually moved in the sheet width direction, and thus the position of the first sheet bundle and the position of the second sheet bundle are changed in the sheet width direction.

SUMMARY

A sheet post-processing device according to one aspect of the present disclosure includes: a stacking tray which stacks sheets conveyed; an alignment member which aligns a sheet bundle formed with the sheets stacked on the stacking tray; and a stapler which performs binding processing on a rear end of the sheet bundle in a conveying direction. The stapler includes: a first stapler which moves along the rear end of the sheet bundle and performs the binding process on a plurality of positions at the rear end of the sheet bundle aligned with the alignment member in a first stacking position on the stacking tray; and a second stapler which is fixed outside a range of the movement of the first stapler on one side in a sheet width direction along the rear end of the sheet bundle and which performs, at one part of an end portion of the rear end on the one side, binding processing different from the first stapler on the sheet bundle moved with the alignment member on the stacking tray from the first stacking position to a second stacking position shifted from the first stacking position to the one side. The alignment member includes: a first alignment member and a second alignment member which slide independently of each other in the sheet width direction with respect to the stacking tray and which sandwich the sheet bundle in the sheet width direction so as to align the sheet bundle in the first stacking position; and a third alignment member which is fixed to a position corresponding to the second stapler such that the second alignment member can be passed through the third alignment member and which sandwiches and aligns the sheet bundle stacked in the second stacking position in the sheet width direction together with the first alignment member in a state where the second alignment member passes through the third alignment member.

Further other objects of the present disclosure and specific advantages obtained by the present disclosure will become more apparent from the description of an embodiment given below.

DETAILED DESCRIPTION

For example, in a configuration in which when a sheet bundle is bound at one part with a second stapler for performing binding processing different from a first stapler that is moved to a plurality of parts, both two alignment members are moved so as to locate the sheet bundle, it is necessary to perform location control on each of the two alignment members. Hence, in order to realize accurate binding processing with the second stapler, it is necessary to perform complicated location control on the two alignment members.

The present disclosure provides: a sheet post-processing device in which when a sheet bundle is bound at one part with a second stapler for performing binding processing different from a first stapler that is moved to a plurality of parts, accurate binding processing using the second stapler can be realized without need to perform complicated location control on alignment members that are used for locating the sheet bundle; and an image forming system which includes such a sheet post-processing device.

Figure 1:
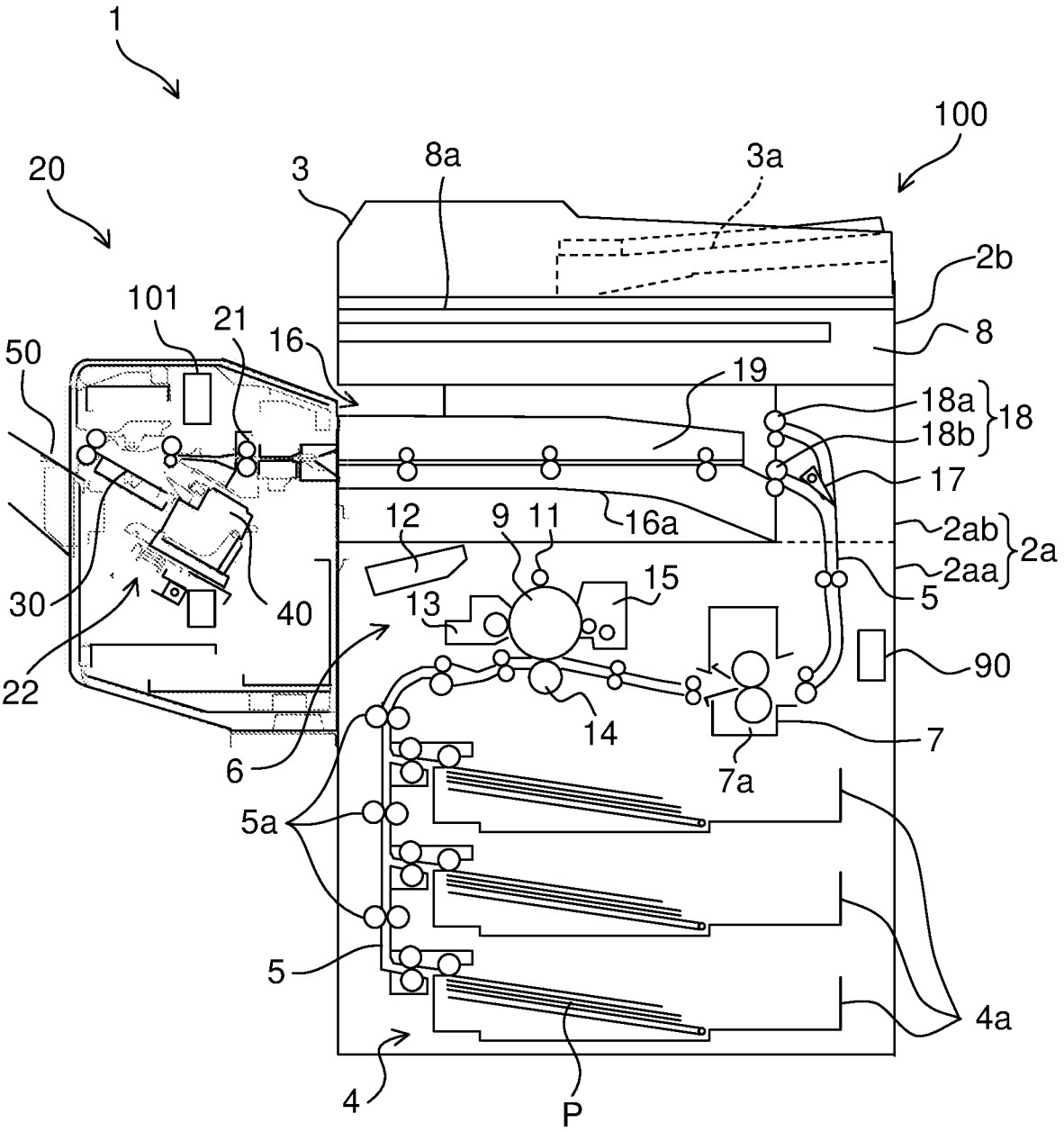
FIG. 1 is a cross-sectional view showing a schematic configuration of an image forming system according to an embodiment of the present disclosure.

An embodiment of the present disclosure will be described below with reference to drawings. FIG. 1 is a cross-sectional view showing a schematic configuration of an image forming system 1 of the present embodiment. The image forming system 1 includes an image forming apparatus 100 and a sheet post-processing device 20. The image forming apparatus 100 forms an image on a sheet P serving as a paper sheet and supplies the sheet P to the sheet post-processing device 20. Although in the present embodiment, as the image forming apparatus 100 described above, a multifunctional machine is illustrated, the image forming apparatus 100 may be an image forming apparatus other than the multifunctional machine such as a laser printer, an inkjet printer or a facsimile machine.

The image forming apparatus 100 is a so-called housing interior paper ejection-type digital multifunctional machine, and is mainly formed with a main body housing 2*a* and an upper housing 2*b* which is arranged thereon. In the upper housing 2*b*, various types of mechanisms are provided which read the image of an original document as electrical signals and which will be described later. In an upper portion of the upper housing 2*b*, an original document conveying device 3 is additionally provided. On the other hand, in the main body housing 2*a*, various types of mechanisms are provided which transfer an image to the sheet P based on the electrical signals of the original document image that are read and which will be described later. On the left side of the main body housing 2*a*, the sheet post-processing device 20 is additionally provided.

In the present embodiment, the main body housing 2*a* is formed with a lower housing 2*aa* and a coupling housing 2*ab*. In the lower housing 2*aa*, a paper feed portion 4 for the sheet P, an image formation portion 6 which forms a toner image on the sheet P, a fixing device 7 for fixing the toner image on the sheet P and the like are provided. The coupling housing 2*ab* is located on the lower housing 2*aa* along a right side portion thereof, and is coupled to the upper housing 2*b*. In the coupling housing 2*ab*, a sheet ejection portion (ejection portion) 18 is provided which conveys the sheet P after the fixing so as to eject the sheet P from the main body housing 20.

On the left side of the coupling housing 2*ab* immediately below the upper housing 2*b*, a housing interior paper ejection space 16 is formed which is widely opened toward a left side surface and a front surface. In the housing interior paper ejection space 16, a relay unit 19 is provided. The relay unit 19 receives the sheet P ejected from the left side surface of the coupling housing 2*ab* so as to stack the sheets P, and conveys the sheet P to the sheet post-processing device 20 when predetermined post-processing is performed on the sheet P.

Within the main body housing 2*a*, the paper feed portion 4 which is arranged in a lower portion, a sheet conveying portion 5 which is arranged on the side of and above the paper feed portion 4, the image formation portion 6 which is arranged above the paper feed portion 4 and the fixing portion 7 which is arranged on a downstream side (the right side of FIG. 1) in a sheet conveying direction with respect to the image formation portion 6 are provided.

In the paper feed portion 4, a plurality of paper feed cassettes 4*a* are provided in which a separation feed means such as a paper feed roller is provided on the downstream side in the sheet conveying direction. By the rotation operation of the paper feed roller, the uppermost sheep P is fed one by one from a bundle of the sheets P placed on the paper feed cassette 4*a* to the sheet conveying portion 5. The sheet conveying portion 5 conveys, with conveying roller pairs 5*a*, the sheet P fed from the paper feed portion 4 to the image formation portion 6.

The image formation portion 6 and the fixing portion 7 are arranged within the apparatus main body 100 so as to be elongated in a width direction (forward/backward direction, direction orthogonal to the plane of FIG. 1) orthogonal to the sheet conveying direction. In an upper portion of the lower housing 2*aa*, the image formation portion 6 and the fixing portion 7 are provided side by side in this order from the left side of FIG. 1 along the conveying direction of the sheet P (direction extending from the left side to the right side).

The image formation portion 6 forms the predetermined toner image on the sheet P by an electrophotographic process. The image formation portion 6 includes a photosensitive drum 9 which is rotatably supported with a shaft and which is an image carrying member. The image formation portion 6 includes a charging device 11, an exposure device 12, a development device 13, a transfer device 14, a cleaning device 15 and an unillustrated static eliminator which are arranged around the photosensitive drum 9 along the direction of rotation thereof. The fixing portion 7 sandwiches the sheet P to which the toner image is transferred in the image formation portion 6 between a pair of fixing rollers 7*a* formed with a heating roller and a pressure roller, and heats and pressurizes the sheet P so as to fix the unfixed toner image on the sheet P.

Within the upper housing 2*b*, an image reading portion 8 is provided which reads the image information of the original document. When the original documents are manually placed one by one so as to be read, the original document conveying device 3 is opened, and the original document is placed on a contact glass 8*a* provided on the upper surface of the upper housing 2*b*. On the other hand, when the original documents are automatically read one by one from an original document bundle, the original document bundle is placed on the paper feed tray 3*a* of the original document conveying device 3 in a closed state. In this case, the original documents are automatically and sequentially fed onto the contact glass 8*a* one by one from the original document bundle placed on the paper feed tray 3*a*. In either case, light from an unillustrated exposure lamp is applied to the original document located on the contact glass 8*a*, the reflected light thereof is guided as image light through an optical system such as a reflective mirror and an imaging lens (both of which are not shown) into a photoelectric conversion portion (CCD) and thus the image information of the original document is acquired.

The basic operation of the image forming apparatus 100 configured as described above will be described below. First, the surface of the photosensitive drum 9 which is rotated counterclockwise in FIG. 1 is uniformly charged with the charging device 11. Then, a laser beam from the exposure device 12 (such as a laser device) is applied based on the image information read in the image reading portion 8 to the circumferential surface of the photosensitive drum 9. In this way, an electrostatic latent image is formed on the surface of the photosensitive drum 9. A toner serving as a developer is supplied from the development device 13 to the electrostatic latent image, and thus the toner image is formed.

Then, the sheet P from the paper feed portion 4 is passed through the sheet conveying path 5 and is conveyed at predetermined timing toward the photosensitive drum 9 on which the toner image is formed. Then, with the transfer device 14 formed with a transfer roller and the like, the toner image on the surface of the photosensitive drum 9 is transferred to the sheet P. The sheet P to which the toner image is transferred is separated from the photosensitive drum 9, and is conveyed toward the fixing portion 7. When the sheet P is passed through the pair of fixing rollers 7*a*, the sheet P is subjected to the heating and pressurization processing, and thus the toner image is fixed.

After the completion of the processing which transfers the toner image to the sheet P, a residual toner left on the circumferential surface of the photosensitive drum 9 is removed with the cleaning device 15. Then, static elimination processing which eliminates residual charge is performed with the static eliminator (not shown) on the circumferential surface of the photosensitive drum 9. Thereafter, with the charging device 11, the charging processing is performed again on the circumferential surface of the photosensitive drum 9, and the image formation is thereafter performed in the same manner.

The sheet P which is passed through the fixing portion 7 is conveyed, without being processed, vertically upward along the sheet conveying path 5 into the coupling housing 2*ab*. Within the coupling housing 2*ab*, an upper portion of the sheet conveying path 5 is extended leftward and is branched into two upper and lower conveying paths. The direction of conveying of the sheet P is switched with a switching claw 17 which is arranged in a branch portion.

Within the coupling housing 2*ab*, the sheet ejection portion 18 is provided. The sheet ejection portion 18 includes an upper ejection roller pair 18*a* and a lower ejection roller pair 18*b* which is arranged immediately below the upper ejection roller pair 18*a*. The sheet P which is conveyed along the sheet conveying path 5 is switched with the switching claw 17 so as to be guided to the upper conveying path or the lower conveying path.

The sheet P which is guided with the switching claw 17 to the upper conveying path is ejected leftward from the upper ejection roller pair 18*a*. On the other hand, the sheet P which is guided with the switching claw 17 to the lower conveying path is ejected leftward with the lower ejection roller pair 18*b*. In the switching claw 17, the guide direction is switched by a main body control portion 90.

The relay unit 19 is removably fitted to the bottom surface 16*a* of the housing interior paper ejection space 16. In the housing interior paper ejection space 16, a detection sensor (not shown) for detecting the fitting of the relay unit 19 is provided. The detection sensor is formed with a PI sensor or the like, and transmits the result of the detection to the main body control portion 90.

In the bottom surface 16*a*, an inclination surface is formed which is inclined upward toward a downstream side in a sheet ejection direction (the left side of FIG. 1), and when the relay unit 19 is separated from the housing interior paper ejection space 16, the bottom surface 16*a* is used as a sheet ejection tray. In this case, when the detection sensor detects that the relay unit 19 is not fitted so as to transmit the result of the detection to the main body control portion 90, the switching claw 17 guides the sheet P to the upper ejection roller pair 18*a*. Then, the sheet P ejected from the upper ejection roller pair 18*a* is ejected onto the bottom surface 16*a*.

On the other hand, when the detection sensor detects that the relay unit 19 is fitted into the housing interior paper ejection space 16 so as to transmit the result of the detection to the main body control portion 90, the switching claw 17 guides the sheet P to the lower ejection roller pair 18*b*. Then, the sheet P ejected from the lower ejection roller pair 18*b* is conveyed into the relay unit 19. The sheet P conveyed into the relay unit 19 is passed within the relay unit 19 and is conveyed into the sheet post-processing device 20.

A configuration can be adopted in which the result of the detection is displayed on an operation portion (not shown) and in which a user switches, on the operation panel of the operation portion, the direction in which the sheet P is guided. An upper surface portion of the relay unit 19 forms a sheet ejection tray on which the sheet P ejected from the upper ejection roller pair 18*a* is placed.

The configuration of the sheet post-processing device 20 will then be described. The sheet post-processing device 20 performs the predetermined post-processing on the sheet which is supplied from the image forming apparatus 100. Within the sheet post-processing device 20, a punch-hole formation device 21 which forms punch holes in the sheet P that is conveyed thereinto and a stapler portion 22 which stacks a plurality of sheets P that are conveyed thereinto so as to perform the binding processing are provided. The stapler portion 22 includes a stacking tray 30 on which the sheets P conveyed thereinto are stacked and a stapler 40 which binds a sheet bundle stacked on the stacking tray 30. On the side surface of the sheet post-processing device 20, an ejection tray 50 is provided which can be raised or lowered to a position suitable for the ejection of the sheet P. The individual portions of the sheet post-processing device 20 are controlled with a post-processing control portion 101.

The punch hole formation device 21 is arranged in an upper portion of the sheet post-processing device 20, and forms a plurality of punch holes along one side end edge (the front side or the back side of the device) parallel to the direction of conveying of the sheet P or along the rear end of the sheet P. A conveying-in detection sensor (not shown) is arranged on the upstream side of the punch-hole formation device 21 and substantially in a center portion in a direction (direction perpendicular to the plane of FIG. 1) orthogonal to the sheet conveying direction. The conveying-in detection sensor detects the tip end of the sheet P which is conveyed into the sheet post-processing device 20 with a sheet conveying-in roller pair within the relay unit 19.

Figure 2:
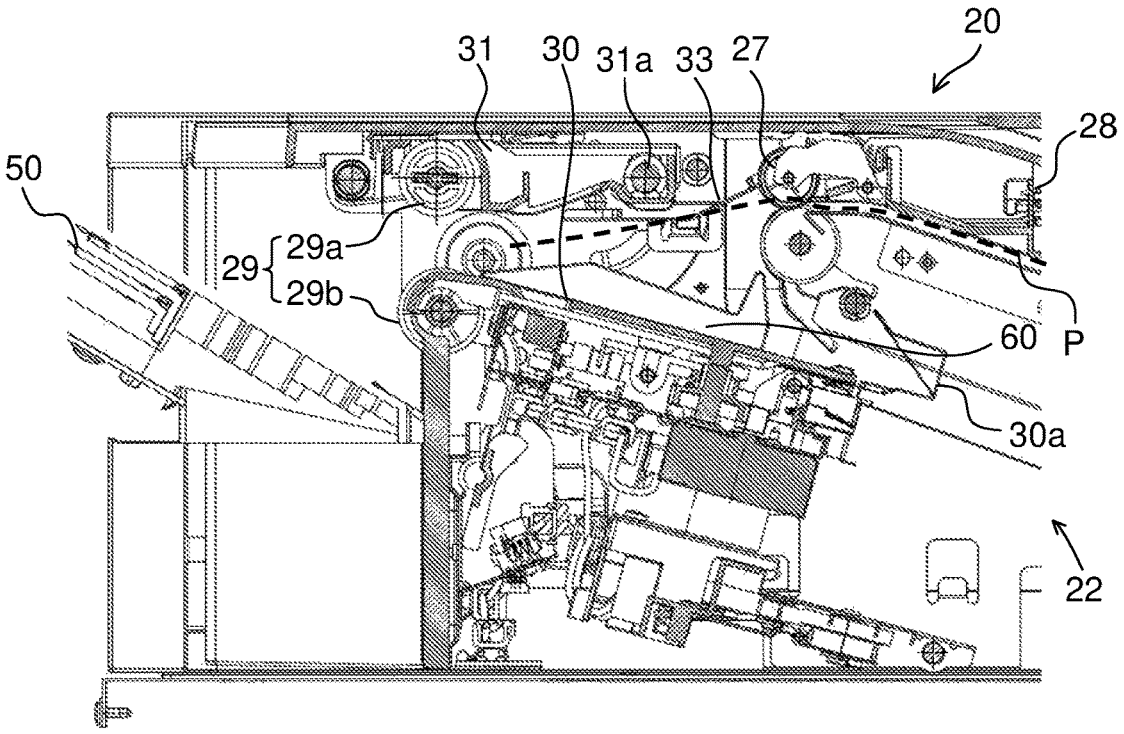
FIG. 2 is a partial cross-sectional view of the vicinity of a stacking tray before the stacking of a sheet in a sheet post-processing device included in the image forming system.
Figure 3:
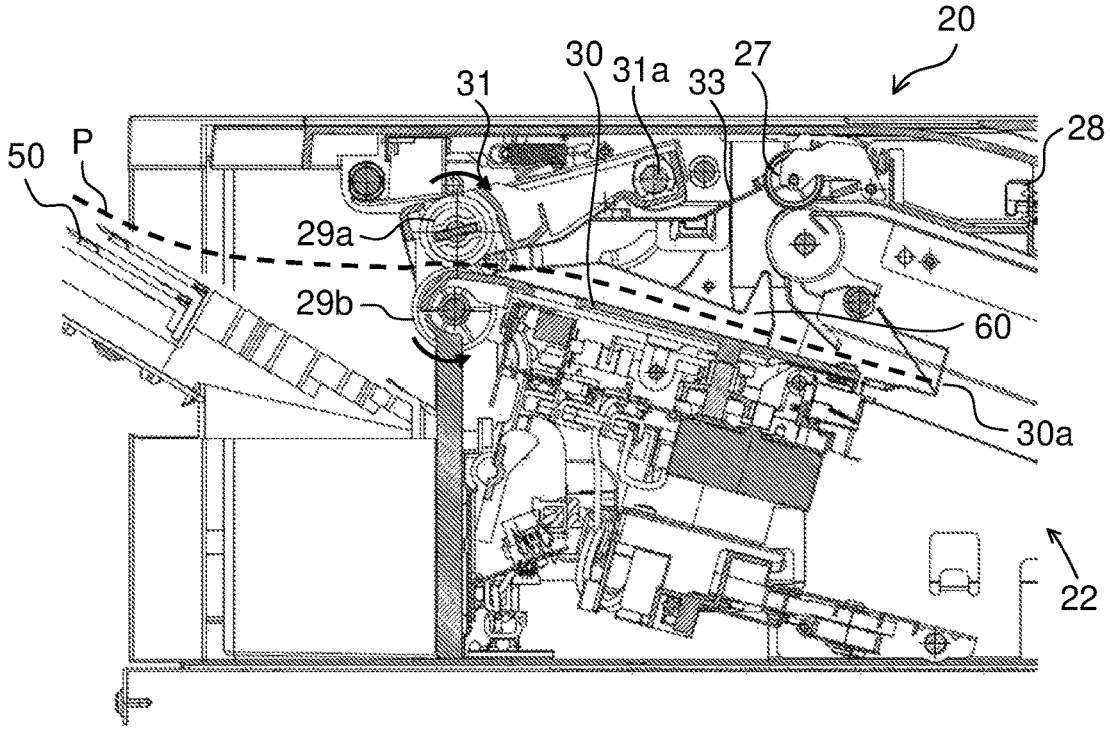
FIG. 3 is a partial cross-sectional view of the vicinity of the stacking tray at the time of the stacking of the sheet in the sheet post-processing device.

FIGS. 2 and 3 are partial cross-sectional views of the vicinity of the stacking tray 30 within the sheet post-processing device 20. On the downstream side of the punch-hole formation device 21 (see FIG. 1) in the sheet conveying direction, a first ejection roller pair 27 is arranged. On the upstream side of the first ejection roller pair 27, an actuator-type sheet detection sensor 28 is arranged which detects the passage of the sheet P.

Furthermore, below the first ejection roller pair 27, the stacking tray 30 which stacks a predetermined number of sheets P conveyed with the first ejection roller pair 27 and which is described above and the stapler 40 (see FIG. 1) which performs the binding processing on a bundle (sheet bundle) of the sheets P placed on the stacking tray 30 are provided.

On the downstream side of the stacking tray 30 in the sheet conveying direction, a second ejection roller pair 29 is arranged. The second ejection roller pair 29 conveys the sheet bundle on which the binding processing has been performed with the stapler 40, and ejects the sheet bundle to the ejection tray 50. The second ejection roller pair 29 are formed with: an ejection roller 29*a* which can be rotated forward and backward with a drive motor (not shown) and which is made of rubber; and an ejection rolling member 29*b* which follows the ejection roller 29*a* so as to be rotated and which is made of resin. The ejection roller 29*a* is supported with a roller holder 31 which can be vertically swung with a rotation shaft 31*a* serving as a support point.

A hitting member 33 is arranged above the stacking tray 30 and on the downstream side (the left side of FIG. 2) of the first ejection roller pair 27. The hitting member 33 is provided in order to hit the sheet P conveyed thereinto with the first ejection roller pair 27 toward the direction of the stacking tray 30 and to thereby put the sheet P along a tray surface. The stacking tray 30 is provided so as to be inclined downward toward the rear end side (the right side of FIG. 2) of the sheets P which are stacked. The second ejection roller pair 29 is rotated backward, and thus the sheet P is drawn onto the stacking tray 30 from the rear end side of the sheet P, and the rear end of the sheet P abuts against an abutting portion 30*a*. In this way, the sheet bundle is stacked on the stacking tray 30 in a state where the rear ends are aligned. In the stacking tray 30, a plurality of alignment members (alignment cursors) 60 are provided which align the sheet bundle stacked on the stacking tray 30 in a sheet width direction (direction perpendicular to the plane of FIG. 2).

The operation of the sheet post-processing device 20 will then be described. When the sheet P (indicated by broken lines of FIGS. 2 and 3) on which the image formation processing has been performed in the image forming apparatus 100 is conveyed thereinto, in a case where an instruction to form punch holes is provided, punch holes are formed with the punch-hole formation device 21 in predetermined positions (for example, two parts along the side end edge on the front side of the device) of the sheet P which is conveyed. When an instruction to form punch holes is not provided, the sheet P is passed through the punch-hole formation device 21 without being processed.

Then, the sheet P is further conveyed with the first ejection roller pair 27 to the downstream side. Here, as shown in FIG. 2, the roller holder 31 is swung upward, and thus the ejection roller 29*a* is arranged in such a position (retracted position) as to be separate from the ejection rolling member 29*b*. Hence, the sheet P conveyed with the first ejection roller pair 27 is passed through a gap between the ejection roller 29*a* and the ejection rolling member 29*b* so as to protrude to the ejection tray 50.

With timing at which the rear end of the sheet P is passed through the first ejection roller pair 27, the roller holder 31 is swung downward, and thus the ejection roller 29*a* is arranged in such a position (abutting position) as to abut against the ejection rolling member 29*b*. Thereafter, the hitting member 33 is driven to put the sheet P along the stacking tray 30. In this state, the ejection roller 29*a* is rotated backward (in the counterclockwise direction of FIG. 3), and thus the sheet P is drawn along the stacking tray 30, with the result that the rear end is aligned with the abutting portion 30*a*. The abutting portion 30*a* is not formed continuously over the entire region in the sheet width direction, and cutouts are partially formed. Here, an upper portion of the sheet P is in a state where the upper portion is nipped with the second ejection roller pair 29, and the tip end of the sheet P is protruded from the second ejection roller pair 29 above the ejection tray 50. When the sheet P is drawn along the stacking tray 30, in a state where the ejection roller 29*a* is pressed to the ejection rolling member 29*b* only by the weight of the roller holder 31, the sheet P is nipped so as not to be drawn more than necessary.

Then, when the reception of one bundle of sheets P is completed, the binding processing is performed on the sheet bundle with the stapler 40. After the binding processing is performed with the stapler 40, the sheet bundle is conveyed upward along the stacking tray 30 by rotating the second ejection roller pair 29 forward (rotating it in the direction of an arrow in FIG. 3), and is thereby ejected onto the ejection tray 50. When the sheet bundle is ejected onto the ejection tray 50, the ejection roller 29*a* is pressed to the ejection rolling member 29*b* not only by the weight of the roller holder 31 but also by the biasing of the roller holder 31 downward with a biasing member such as a spring. In this way, the sheet bundle is nipped by a force greater than a force when the sheet P is drawn, and thus it is possible to reliably eject the sheet bundle onto the ejection tray 50.

Figure 4:
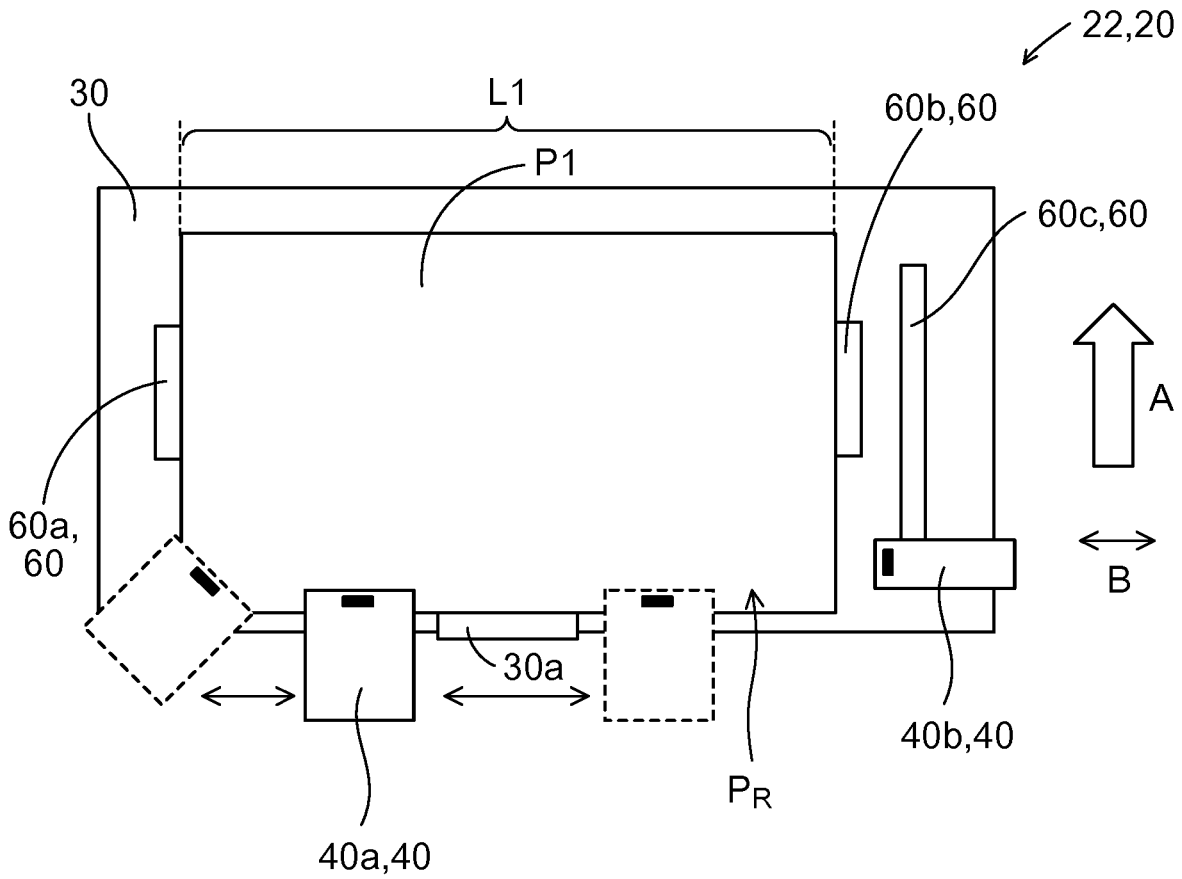
FIG. 4 is a plan view showing the configuration of the vicinity of the stacking tray and schematically showing the positions of a first alignment member, a second alignment member and a third alignment member when binding processing is performed on a first sheet bundle on the stacking tray.

The details of the stapler portion 22 discussed above will then be described. FIG. 4 is a plan view schematically showing the configuration of the vicinity of the stacking tray 30 in the stapler portion 22. For convenience of description below, the direction of conveying (direction of ejection) of the sheet bundle with the second ejection roller pair 29 is assumed to be an A direction, and the sheet width direction perpendicular to the A direction is assumed to be a B direction. The B direction is also a direction along the rear end $P_R$ (the end edge on the upstream side in the A direction) of the sheet bundle.

The stapler portion 22 includes a plurality of alignment members 60. The alignment members 60 align a sheet bundle formed with a plurality of sheets P which are stacked on the stacking tray 30. The alignment members 60 as described above are formed with a first alignment member 60*a*, a second alignment member 60*b* and a third alignment member 60*c*. The first alignment member 60*a*, the second alignment member 60*b* and the third alignment member 60*c* each are formed so as to be long in the A direction.

Figure 8:
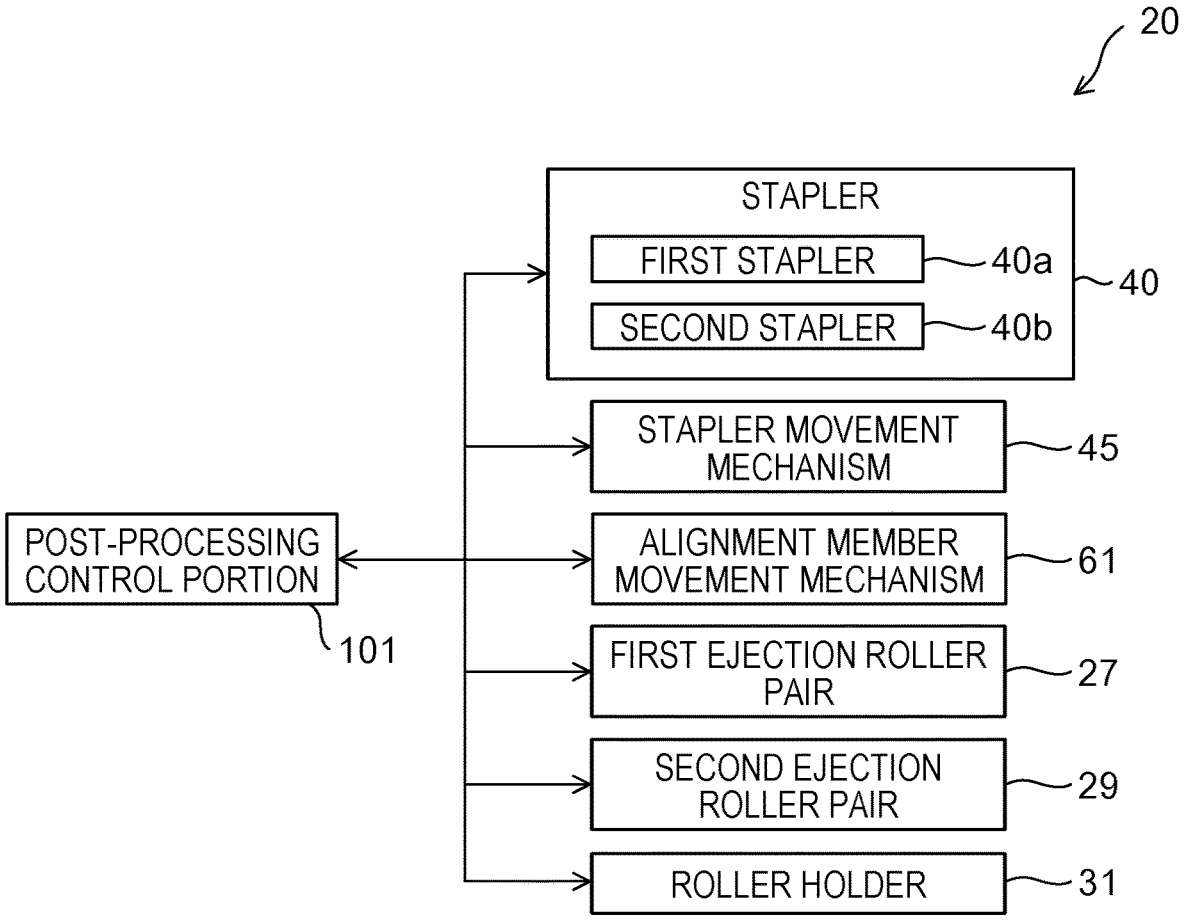
FIG. 8 is a block diagram schematically showing the configuration of a main portion of the sheet post-processing device.

The first alignment member 60*a* and the second alignment member 60*b* can be moved (shifted) in the B direction with an alignment member movement mechanism 61 (see FIG. 8). On the other hand, the third alignment member 60*c* is placed on the stacking tray 30 and is fixed to a second stapler 40*b* which will be described later. Hence, a positional relationship between the third alignment member 60*c* and the second stapler 40*b* is fixed. The alignment member movement mechanism 61 includes support members for individually supporting the first alignment member 60*a* and the second alignment member 60*b*, motors for moving the individual support members and the like, and thus it is possible to independently move the first alignment member 60*a* and the second alignment member 60*b* in the B direction.

Figure 5:
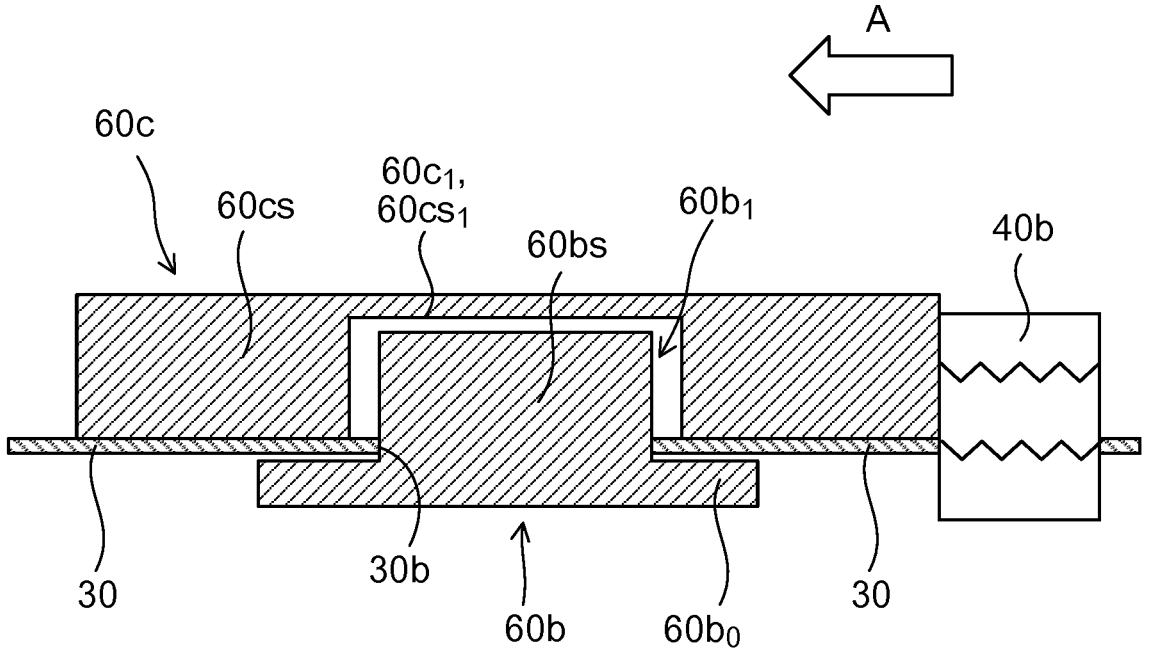
FIG. 5 is a cross-sectional view schematically showing an example of the shapes of the second alignment member and the third alignment member when they are seen in a sheet width direction perpendicular to a sheet conveying direction.

FIG. 5 schematically shows an example of the shapes of the second alignment member 60*b* and the third alignment member 60*c* when they are seen in the B direction. The third alignment member 60*c* includes an opening portion $\mathbf{60}c_1$ which penetrates in the B direction and whose lower side is opened. The second alignment member 60*b* includes a flat plate portion $\mathbf{60}b_0$ which is long in the A direction and a convex portion $\mathbf{60}b_1$ which is protruded upward from the flat plate portion $\mathbf{60}b_0$. The convex portion $\mathbf{60}b_1$ has, when seen in the B direction, a cross-sectional shape along the opening portion $\mathbf{60}c_1$ of the third alignment member 60*c*, and can be enter the opening portion $\mathbf{60}c_1$ through a groove portion 30*b* which is provided in the stacking tray 30 and which is long in the B direction.

In this configuration, the convex portion $\mathbf{60}b_1$ is moved along the groove portion 30*b* in the B direction so as to pass within the opening portion $\mathbf{60}c_1$, and thus the second alignment member 60*b* can be moved to pass through the third alignment member 60*c* in the B direction without interfering with the third alignment member 60*c*. In this way, the second alignment member 60*b* can be moved so as to change from the state of FIG. 4 to the state of FIG. 6 or vice versa. In other words, the second alignment member 60*b* can be moved in the B direction from the position on the same side as the first alignment member 60*a* with respect to the third alignment member 60*c* to the position (outside of the third alignment member 60*c* in the B direction) on the side opposite to the first alignment member 60*a* with respect to the third alignment member 60*c*, and can also be moved in the direction opposite thereto.

Figure 7:
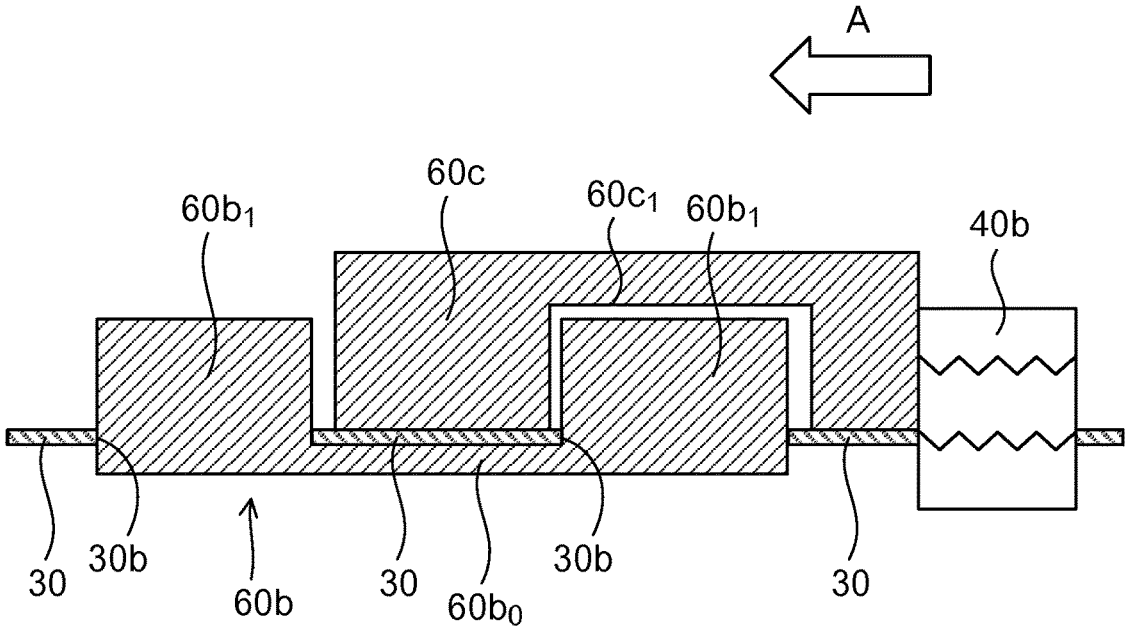
FIG. 7 is a cross-sectional view schematically showing another example of the shapes of the second alignment member and the third alignment member when they are seen in the sheet width direction.

The shapes of the second alignment member 60*b* and the third alignment member 60*c* are not limited to the shapes shown in FIG. 4. FIG. 7 schematically shows another example of the shapes of the second alignment member 60*b* and the third alignment member 60*c* when they are seen in the B direction. As shown in the figure, the second alignment member 60*b* and the third alignment member 60*c* may have shapes which engage with each other when they are seen in the B direction. In addition, the second alignment member 60*b* may include an opening portion which penetrates in the B direction, and the third alignment member 60*c* may include a convex portion which enters the opening portion of the second alignment member 60*b*.

Here, the second alignment member 60*b* and the third alignment member 60*c* described above can be said to have the following configurations. Specifically, as shown in FIG. 5, the second alignment member 60*b* includes a first alignment surface 60*bs* which makes contact with the sheet bundle at the time of alignment, and the third alignment member 60*c* includes a second alignment surface 60*cs* which makes contact with the sheet bundle at the time of alignment. The second alignment surface 60*cs* includes an opening $\mathbf{60}cs_1$ through which the first alignment surface 60*bs* can be passed. The opening $\mathbf{60}cs_1$ is part of the opening portion $\mathbf{60}c_1$ described above.

The first alignment surface 60*bs* is passed within the opening $\mathbf{60}cs_1$ in the B direction, and thus the second alignment member 60*b* can be moved to pass through the third alignment member 60*c* in the B direction without interfering with the third alignment member 60*c*. In this way, the second alignment member 60*b* can be moved so as to change from the state of FIG. 4 to the state of FIG. 6 or vice versa. The first alignment surface 60*bs* of the second alignment member 60*b* may naturally include an opening through which the second alignment surface 60*cs* of the third alignment member 60*c* can be passed. In other words, one of the first alignment surface 60*bs* and the second alignment surface 60*cs* may include an opening through which the other of the first alignment surface 60*bs* and the second alignment surface 60*cs* can be passed when the second alignment member 60*b* is moved in the sheet width direction (B direction).

The stapler portion 22 includes the stapler 40 described above. The stapler 40 performs the binding processing on the rear end $P_R$ of the sheet bundle which is aligned on the stacking tray 30 with a plurality of alignment members 60. The stapler 40 as described above includes a first stapler 40*a* and the second stapler 40*b*. The first stapler 40*a* is moved to a plurality of parts of the rear end $P_R$ of the sheet bundle in the B direction so as to perform, with needles, the binding processing on the sheet bundle. On the other hand, on one side in the B direction, the second stapler 40*b* is fixed outside the range of the movement of the first stapler 40*a*, and performs binding processing different from the first stapler 40*a* on the sheet bundle at one part of an end portion $P_{RE}$ (see FIG. 6) of the rear end $P_R$ on the one side described above. Here, the binding processing different from the first stapler 40*a* is assumed to be binding processing which binds the sheet bundle without use of needles. Examples of the binding processing without use of needles include: processing which presses the sheet bundle with a tooth mold so as to provide recesses and projections and which thereby bonds, by pressure, the stacked sheets; processing which cuts a slit in the sheet bundle in the direction of thickness and which folds part of the sheet bundle along the slit so as to combine the sheet bundle together; and the like.

Here, the sheet bundle on which the binding processing is performed with the first stapler 40*a* is also referred to as a first sheet bundle P1 in the following description. The sheet bundle on which the binding processing is performed with the second stapler 40*b* is also referred to as a second sheet bundle P2 in the following description. The maximum thickness of the second sheet bundle P2 on which the binding processing can be performed with the second stapler 40*b* is smaller than the maximum thickness of the first sheet bundle P1 on which the binding processing can be performed with the first stapler 40*a*. In other words, when the thicknesses of the sheets P of the first sheet bundle P1 and the second sheet bundle P2 are assumed to be constant, the maximum number of sheets in the second sheet bundle P2 on which the binding processing can be performed with the second stapler 40*b* is smaller than the maximum number of sheets in the first sheet bundle P1 on which the binding processing can be performed with the first stapler 40*a*.

Hence, the width, in an up/down direction (direction perpendicular to the A direction and the B direction), of the entrance of the second stapler 40*b* through which the second sheet bundle P2 is inserted is formed to be narrower than the width in the up/down direction of the entrance of the first stapler 40*a* through which the first sheet bundle P1 is inserted.

Figure 6:
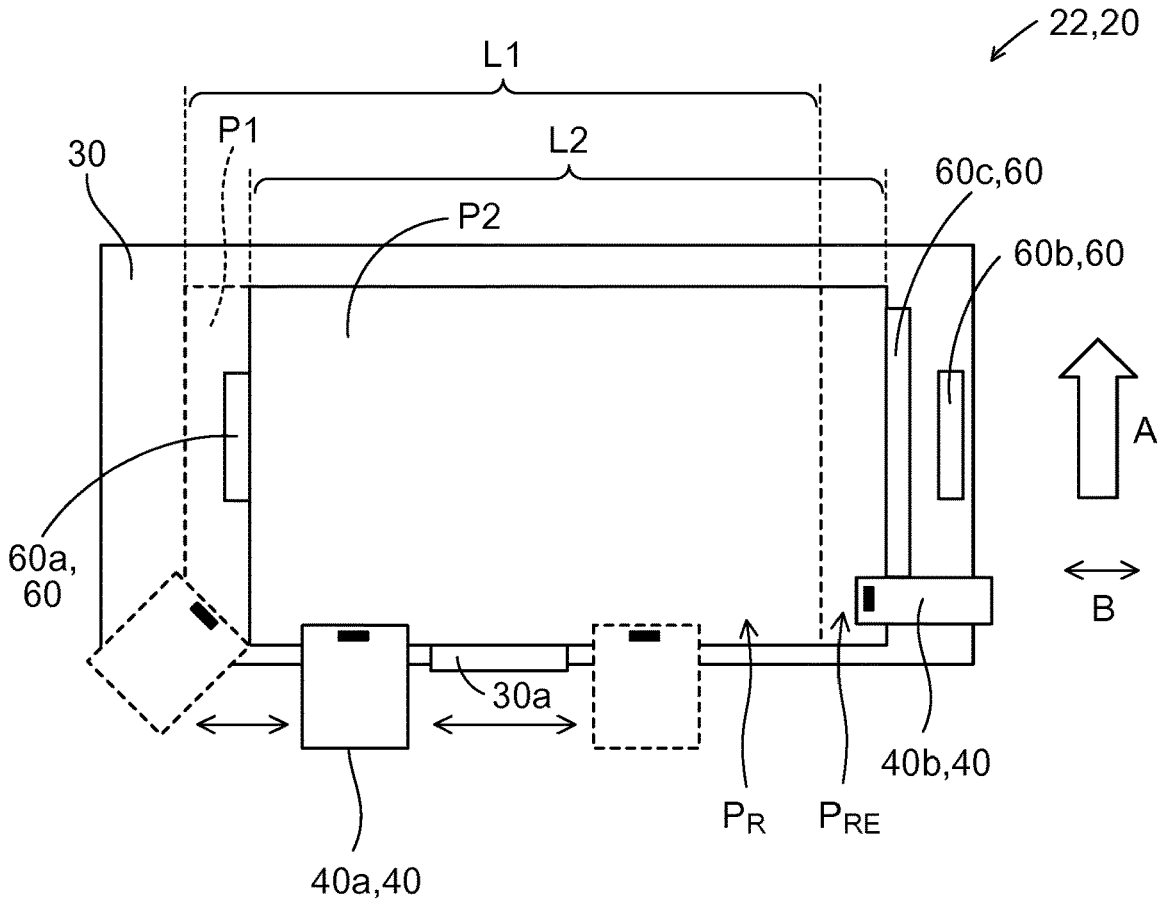
FIG. 6 is a plan view showing the configuration of the vicinity of the stacking tray and schematically showing the positions of the first alignment member, the second alignment member and the third alignment member when the binding processing is performed on a second sheet bundle on the stacking tray.

Hence, as shown in FIG. 4, the second stapler 40*b* is arranged in such a position as not to interfere with the first sheet bundle P1 which is bound with the first stapler 40*a*, that is, in a position outside the first sheet bundle P1 in the B direction. Therefore, as shown in FIG. 6, a first stacking position L1 and a second stacking position L2 are displaced in the B direction. The first stacking position L1 refers to a rectangular range (region overlaid on the first sheet bundle P1) in which the first sheet bundle P1 is placed on the stacking tray 30 when the first sheet bundle P1 is bound with the first stapler 40*a* (for example, at the time of corner binding). The second stacking position L2 refers to a rectangular range (region overlaid on the second sheet bundle P2) in which the second sheet bundle P2 is placed on the stacking tray 30 when the second sheet bundle P2 is bound with the second stapler 40*b*.

In the present embodiment, the stapler portion 22 includes a stapler movement mechanism 45 (see FIG. 8) which moves the first stapler 40*a* to a plurality of parts in the B direction. The stapler movement mechanism 45 includes a rail for moving the first stapler 40*a* along the B direction, a support member which supports the first stapler 40*a*, a motor for moving the support member along the rail in the B direction and the like. The first stapler 40*a* is moved in the B direction with the stapler movement mechanism 45, and thus the first stapler 40*a* can perform the binding processing at least one part of the first sheet bundle P1 in the B direction.

FIG. 8 is a block diagram schematically showing the configuration of a main portion of the sheet post-processing device 20. The operations of the stapler 40 (the first stapler 40*a* and the second stapler 40*b*), the stapler movement mechanism 45, the alignment member movement mechanism 61, the first ejection roller pair 27, the second ejection roller pair 29, the roller holder 31 and the like described above are controlled with the post-processing control portion 101 of the sheet post-processing device 20. The post-processing control portion 101 includes, for example, a central processing unit called a CPU and a storage portion of a ROM (Read Only Memory), a RAM (Random Access Memory) and the like.

A description will then be given of the movement of the alignment members 60 when in the stapler portion 22 configured as described above, the binding processing is performed with the stapler 40 (the first stapler 40*a* and the second stapler 40*b*).

First, for example, when the binding processing using the stapler 40 is specified on the operation panel (not shown) of the image forming apparatus 100, the alignment member movement mechanism 61 individually locates the first alignment member 60*a* and the second alignment member 60*b* outside the first stacking position L1 in the B direction (standby position). Here, the second alignment member 60*b* is located on the side of the first alignment member 60*a* in the B direction with respect to the third alignment member 60*c*. When the sheet P is ejected from the image forming apparatus 100 and is conveyed into the sheet post-processing device 20, each time the sheet P which is conveyed is stacked in the first stacking position L1 of the stacking tray 30, an alignment operation is repeated which moves the first alignment member 60*a* and the second alignment member 60*b* in the B direction and which sandwiches the sheet P in the B direction.

When the stacking of the sheets P on the stacking tray 30 is completed, and the binding processing using the first stapler 40*a* is specified on the operation panel, the first stapler 40*a* is moved to a desired position, and the first stapler 40*a* performs the binding processing on the first sheet bundle P1 which is stacked and aligned in the first stacking position L1. Thereafter, with the second conveying roller pair 29, the first sheet bundle P1 is ejected to the ejection tray 50. When the number of sheets in the first sheet bundle P1 is large, the abutting portion 30*a* (see FIGS. 2 to 4 and the like) may be moved in the A direction such that the first sheet bundle P1 after the binding processing is ejected. The rotation of the second conveying roller pair 29 and the movement of the abutting portion 30*a* may be performed together so as to eject the first sheet bundle P1.

On the other hand, when the binding processing using the second stapler 40*b* is specified on the operation panel, the alignment member movement mechanism 61 moves the first alignment member 60*a* and the second alignment member 60*b* in the B direction so as to move the sheet bundle stacked in the first stacking position L1 to the second stacking position L2. Here, the second alignment member 60*b* is moved outside in the B direction such that, for example, the second alignment member 60*b* is located on the side opposite to the first alignment member 60*a* with respect to the third alignment member 60*c*. Hence, the sheet bundle described above is sandwiched between the first alignment member 60*a* and the third alignment member 60*c* in the B direction so as to be aligned as the second sheet bundle P2 in the second stacking position L2. Thereafter, the second stapler 40*b* performs the binding processing on the second sheet bundle P2 in the second stacking position L2. After the binding processing, the second sheet bundle P2 is ejected to the ejection tray 50 by the rotation of the second conveying roller pair 29 and/or the movement of the abutting portion 30*a* in the A direction.

When the sheet bundle (first sheet bundle P1) is located with respect to the first stapler 40*a* which is moved, it is necessary to perform location control for moving both the two alignment members (the first alignment member 60*a* and the second alignment member 60*b*) in the B direction. On the other hand, when the sheet bundle (second sheet bundle P2) is located with respect to the second stapler 40*b* whose position is fixed (is not moved), as in the present embodiment, the third alignment member 60*c* is provided so as to be fixed corresponding to the second stapler 40*b*, and thus the first alignment member 60*a* is only moved such that the sheet bundle is sandwiched between the first alignment member 60*a* and the third alignment member 60*c*, with the result that the sheet bundle described above can be simply arranged (located) in a desired position (second stacking position L2). Hence, when the binding processing is performed with the second stapler 40*b*, it is possible to realize accurate binding processing without need to perform complicated location control on the two alignment members as in the case where both the two alignment members for sandwiching the sheet bundle in the B direction are moved so as to locate the sheet bundle.

When the first sheet bundle P1 is bound with the first stapler 40*a*, the second alignment member 60*b* is located between the first alignment member 60*a* and the third alignment member 60*c* in the B direction whereas when the second sheet bundle P2 is bound with the second stapler 40*b*, the second alignment member 60*b* is located on the side (outside in the B direction) opposite to the first alignment member 60*a* with respect to the third alignment member 60*c*. Hence, when the first sheet bundle P1 is bound with the first stapler 40*a*, the first sheet bundle P1 is sandwiched between the first alignment member 60*a* and the second alignment member 60*b*, and thus the first sheet bundle P1 can be aligned in the first stacking position L1. On the other hand, when the second sheet bundle P2 is bound with the second stapler 40*b*, since the second alignment member 60*b* is present in such a position that the second alignment member 60*b* is retracted from between the first alignment member 60*a* and the third alignment member 60*c*, the second sheet bundle P2 is sandwiched between the first alignment member 60*a* and the third alignment member 60*c*, and thus the second sheet bundle P2 can be aligned in the second stacking position L2.

One of the second alignment member 60*b* and the third alignment member 60*c* includes the opening portion (for example, the opening portion $60c_1$) which penetrates in the B direction, and the other includes the convex portion (for example, the convex portion $60b_1$) which enters the opening portion described above. For example, the convex portion $60b_1$ enters the opening portion $60c_1$, and thus, as described above, the second alignment member 60*b* can slide in the B direction so as to pass through the third alignment member 60*c* without interfering with the third alignment member 60*c*. The second alignment surface 60*cs* of the third alignment member 60*c* includes the opening $60cs_1$ through which the first alignment surface 60*bs* of the second alignment member 60*b* can be passed, and thus the second alignment member 60*b* likewise can slide in the B direction so as to pass through the third alignment member 60*c* without interfering with the third alignment member 60*c*.

In this way, when the binding processing is performed with the first stapler 40*a*, in the B direction, the second alignment member 60*b* is located on the same side as the first alignment member 60*a* with respect to the third alignment member 60*c*, and the first sheet bundle P1 is sandwiched between the first alignment member 60*a* and the second alignment member 60*b*, with the result that the first sheet bundle P1 can be reliably aligned in the first stacking position L1. When the binding processing is performed with the second stapler 40*b*, in the B direction, the second alignment member 60*b* is located on the side opposite to the first alignment member 60*a* with respect to the third alignment member 60*c*, and the second sheet bundle P2 is sandwiched between the first alignment member 60*a* and the third alignment member 60*c*, with the result that the second sheet bundle P2 can be reliably aligned in the second stacking position L2.

The third alignment member 60*c* is directly fixed to the second stapler 40*b*, and thus it is possible to reliably realize the corresponding positional relationship between the third alignment member 60*c* and the second stapler 40*b*, with the result that it is possible to obtain the effects of the present embodiment described above.

The maximum thickness of the second sheet bundle P2 on which the binding processing can be performed with the second stapler 40*b* is smaller than the maximum thickness of the first sheet bundle P1 on which the binding processing can be performed with the first stapler 40*a*. In such a configuration, as described above, in order to prevent the second stapler 40*b* from interfering with the first sheet bundle P1, it is necessary to arrange, in the B direction, the second stapler 40*b* outside the first stacking position L1 of the first sheet bundle P1, with the result that the first stacking position L1 and the second stacking position L2 of the second sheet bundle P2 are displaced in the B direction. Hence, the configuration of the present embodiment is significantly effective in which in order to realize accurate binding processing on the second sheet bundle P2, the third alignment member 60*c* whose positional relationship with the second stapler 40*b* is fixed is used so as to align the second sheet bundle P2.

The binding processing performed with the first stapler 40*a* is binding processing using needles, and the binding processing performed with the second stapler 40*b* is binding processing without use of needles. In the binding processing without use of needles, as compared with the binding processing using needles, the thickness (number) of the sheets P on which the binding processing can be performed is generally small. Hence, as in the case described above, in order to prevent the second stapler 40*b* from interfering with the first sheet bundle P1, it is necessary to arrange, in the B direction, the second stapler 40*b* outside the first stacking position L1 of the first sheet bundle P1. Hence, the configuration of the present embodiment is significantly effective in which in order to realize accurate binding processing on the second sheet bundle P2, the third alignment member 60*c* whose positional relationship with the second stapler 40*b* is fixed is used so as to align the second sheet bundle P2.

The first stapler 40*a* is moved in the B direction so as to perform the binding processing on the first sheet bundle P1 at least one part in the B direction. In the configuration in which the first stapler 40*a* is moved in the B direction so as to perform the binding processing as described above, as compared with a configuration in which a plurality of first staplers 40*a* are aligned in the B direction so as to selectively perform the binding processing, the number of first staplers 40*a* used is reduced, and it is advantageous in terms of cost. Hence, in the configuration in which the first stapler 40*a* and the second stapler 40*b* described above are provided together, it is possible to obtain the effects of the present embodiment described above.

Figure 9:
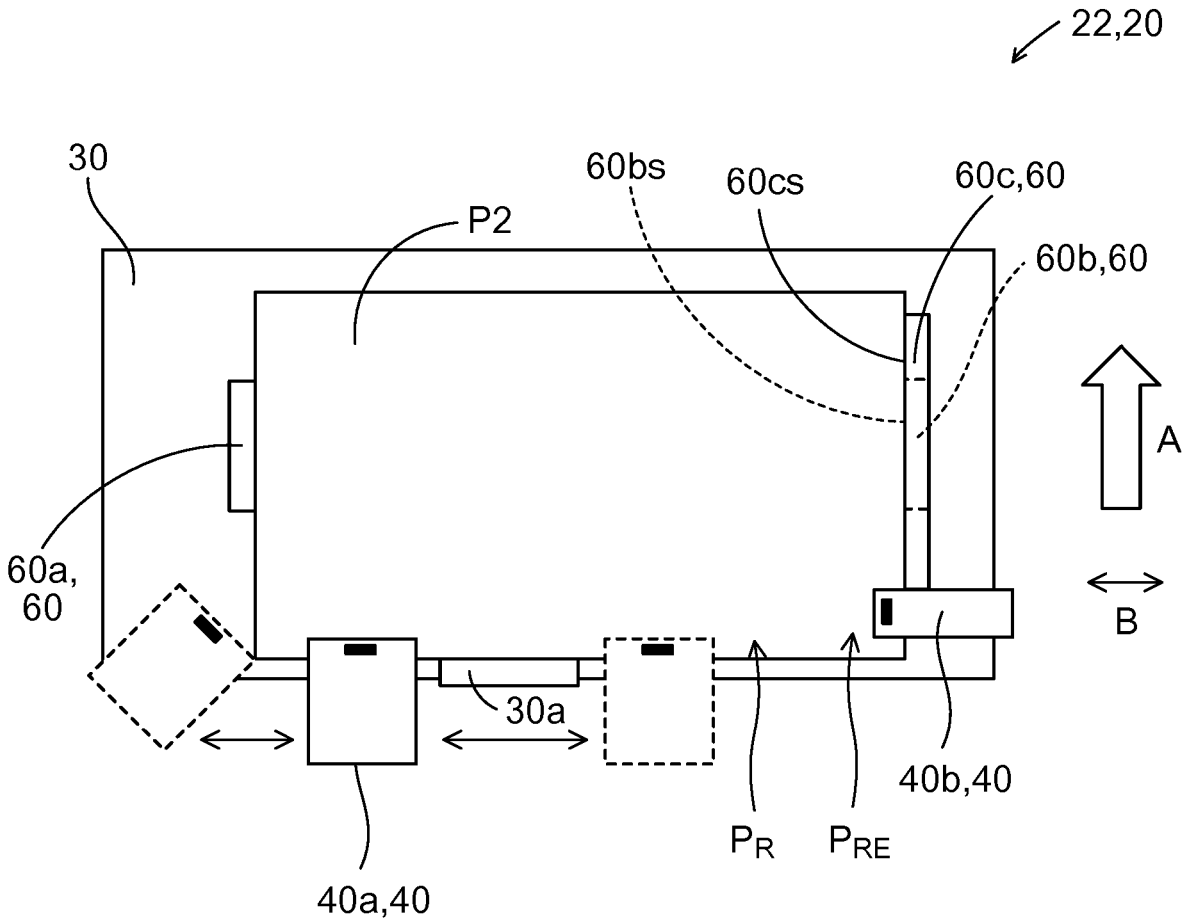
FIG. 9 is a plan view showing another example of the shift position of the second alignment member when the binding processing is performed on the second sheet bundle.

FIG. 9 is a plan view showing another example of the shift position of the second alignment member 60*b* when the binding processing is performed on the second sheet bundle P2 with the second stapler 40*b*. As shown in the figure, when the binding processing is performed with the second stapler 40*b*, the second alignment member 60*b* may be arranged in the same position as the third alignment member 60*c* in the B direction. In other words, the second alignment member 60*b* may be located such that the first alignment surface 60*bs* of the second alignment member 60*b* and the second alignment surface 60*cs* of the third alignment member 60*c* are the same flat surface. Even in this case, the second alignment member 60*b* is prevented from interfering with the alignment of the sheet bundle using the first alignment member 60*a* and the third alignment member 60*c*, and thus the sheet bundle is aligned in the second stacking position L2 with the first alignment member 60*a* and the third alignment member 60*c*, with the result that it is possible to reliably perform the binding processing with the second stapler 40*b*.

Figure 10:
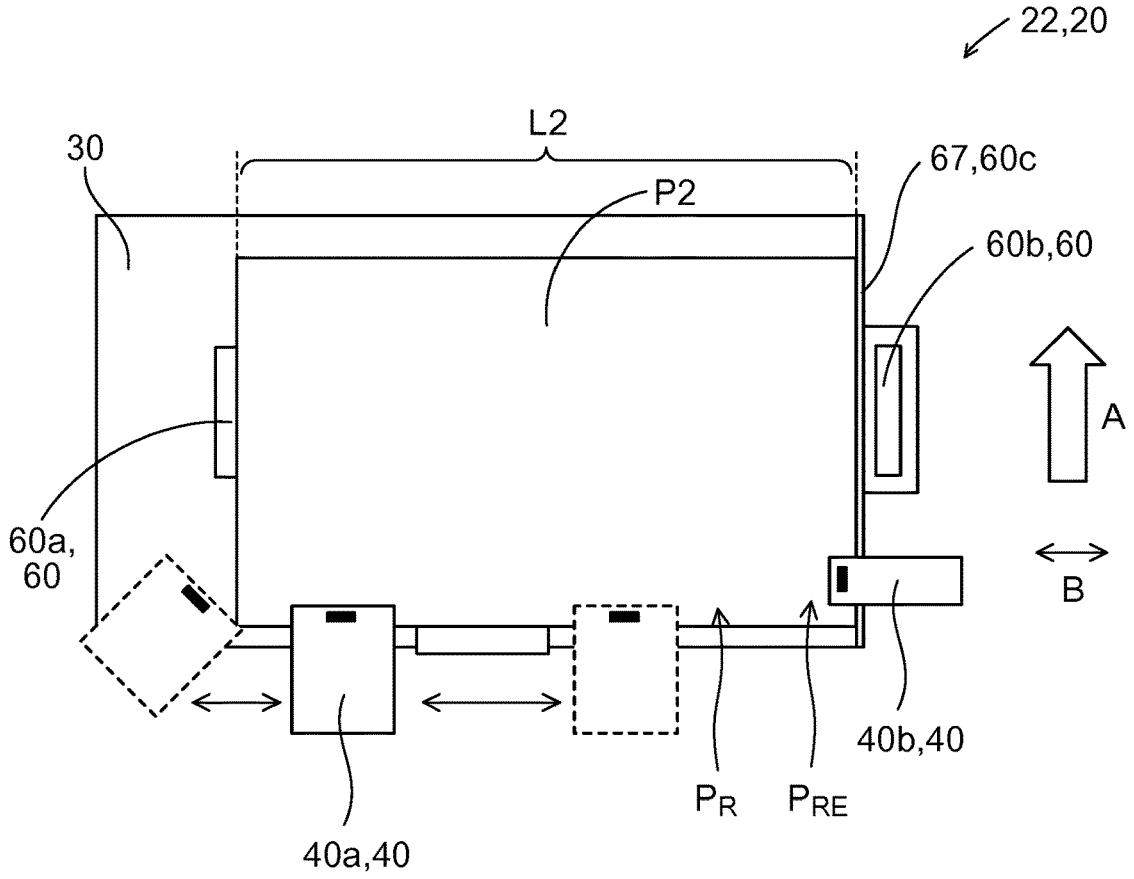
FIG. 10 is a plan view showing another configuration of the vicinity of the stacking tray.
Figure 11:
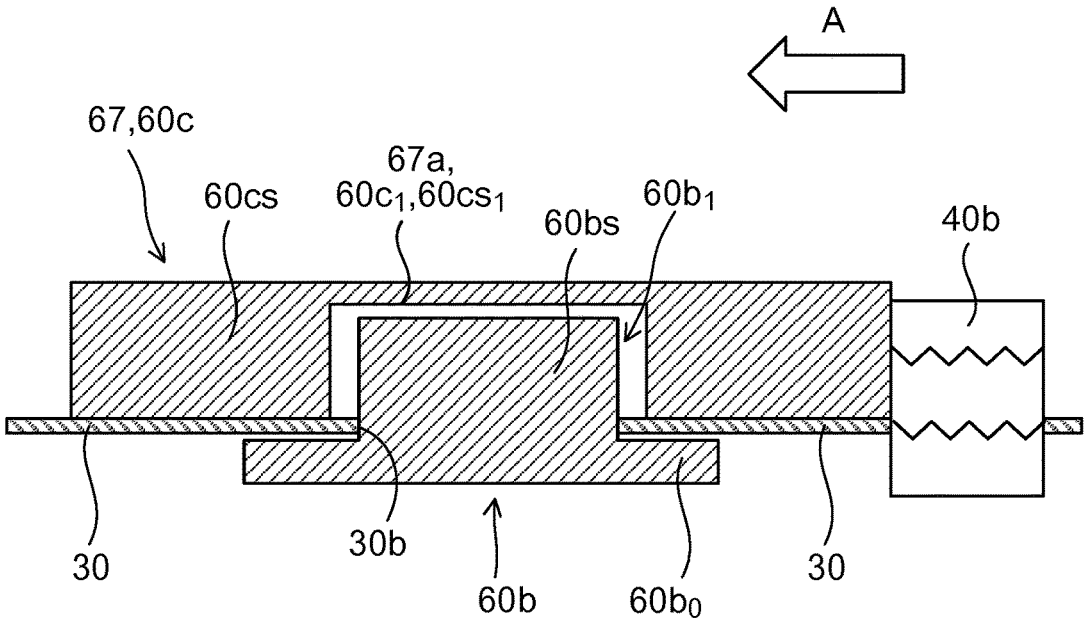
FIG. 11 is a cross-sectional view of a side plate which is part of a frame that holds the stacking tray.

FIG. 10 is a plan view showing another configuration of the vicinity of the stacking tray 30. The sheet post-processing device 20 may further include a side plate 67. The side plate 67 is part of a frame which holds the stacking tray 30, and is extended along the A direction. The second stapler 40*b* is fixed to the side plate 67. As shown in FIG. 11, the side plate 67 includes an opening through which the second alignment member 60*b* (for example, the convex portion $60b_1$) can be passed when the second alignment member 60*b* is moved in the sheet width direction (B direction), and also serves as the third alignment member 60*c* described above.

Hence, the opening 67*a* of the side plate 67 corresponds to the opening portion 60*c*$_1$ of the third alignment member 60*c* described above. As described above, the side plate 67 also serves as the third alignment member 60*c*, and thus it can be said that the side plate 67 is fixed to a position corresponding to the second stapler 40*b* and that a positional relationship between the side plate 67 and the second stapler 40*b* is fixed.

In this configuration, when the binding processing is performed on the second sheet bundle P2 with the second stapler 40*b*, the first alignment member 60*a* is made to slide in the B direction, and thus the sheet bundle is sandwiched between the first alignment member 60*a* and the side plate 67 in the B direction, with the result that the sheet bundle can be aligned in the second stacking position L2. The second alignment member 60*b* can be passed through the opening 67*a* of the side plate 67 in the B direction, and thus the second alignment member 60*b* is prevented from interfering with the sandwiching of the sheet bundle between the first alignment member 60*a* and the side plate 67. In this configuration, the side plate 67 also serves as the third alignment member 60*c*, and thus it is not necessary to newly provide, in order to locate the sheet bundle, another component which is the third alignment member 60*c*, with the result that it is possible to decrease the number of components so as to contribute to the reduction of the cost of the device.

Figure 12:
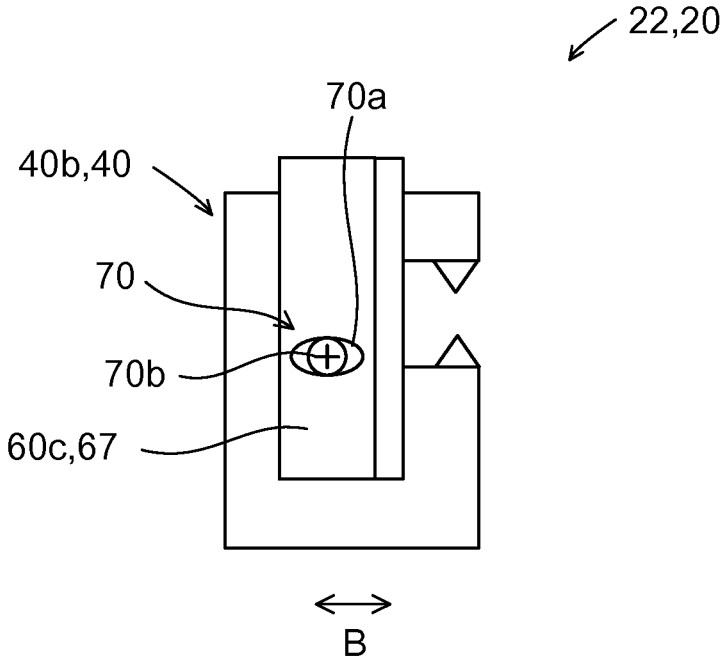
FIG. 12 is a side view of the third alignment member when the third alignment member is seen in the sheet conveying direction.

FIG. 12 is a side view of the third alignment member 60*c* in the A direction. The sheet post-processing device 20 of the present embodiment may further include an adjustment mechanism 70. The adjustment mechanism 70 is a mechanism which adjusts, in the sheet width direction (B direction), the position in which the third alignment member 60*c* is fixed to the second stapler 40*b*. The adjustment mechanism 70 includes, for example, a long hole 70*a* which is provided in the side surface of the third alignment member 60*c* and whose diameter is long in the B direction and an adjustment screw 70*b* which is inserted through the long hole 70*a* and which fixes the third alignment member 60*c* to the second stapler 40*b*.

In this configuration, the adjustment screw 70*b* is loosened to move the third alignment member 60*c* in the B direction with respect to the second stapler 40*b* and to thereby adjust the position, and thereafter, the adjustment screw 70*b* is tightened to be able to fix the position of the third alignment member 60*c* in the B direction. Hence, the position (second stacking position L2) of the second sheet bundle P aligned with the third alignment member 60*c* is adjusted in the B direction, and thus it is possible to adjust the depth of the binding using the second stapler 40*b* in the B direction.

The third alignment member 60*c* may be the side plate 67 in FIG. 10. In other words, even in the configuration in which the side plate 67 also serves as the third alignment member 60*c*, the adjustment mechanism 70 is applied, and thus it is possible to obtain the effects described above.

In the embodiment described above, when the positional relationship between the third alignment member and the second stapler 40*b* is fixed, the third alignment member 60*c* (or the side plate 67) does not need to be directly fixed to the second stapler 40*b* and may be indirectly fixed through any member.

The second stapler 40*b* described above is preferably a stapler which performs the binding processing on the second sheet bundle P2 at one preset part in the B direction, and is not limited to the stapler which performs the binding processing without use of needles as in the present embodiment. For example, the second stapler 40*b* may perform the binding processing on the sheet bundle with needles whose type (such as the depth of the needle, the width of the needle, the thickness of the needle or the material of the needle) is different from the first stapler 40*a*.

As described above, in the present embodiment, the alignment members 60 include the first alignment member 60*a*, the second alignment member 60*b* and the third alignment member 60*c*. The first alignment member 60*a* and the second alignment member 60*b* slide independently of each other in the sheet width direction with respect to the stacking tray 30, and sandwich the sheet bundle in the sheet width direction so as to align the sheet bundle in the first stacking position L1. The third alignment member 60*c* is fixed to the position corresponding to the second stapler 40*b* such that the second alignment member 60*b* can be passed through the third alignment member 60*c*, and sandwiches, in the second stacking position L2, the sheet bundle in the sheet width direction with the first alignment member 60*a* which slides in the sheet width direction so as to align the sheet bundle in the second stacking position L2.

In the present embodiment, the third alignment member is fixed to the position corresponding to the second stapler, and thus when the sheet bundle is located with respect to the second stapler, the first alignment member is only moved such that the sheet bundle is sandwiched between the first alignment member and the third alignment member, with the result that the sheet bundle can be simply and accurately arranged (located) in a desired position (second stacking position). Hence, in order to realize accurate binding processing using the second stapler, it is not necessary to perform complicated location control on the first alignment member. In other words, without need to perform complicated location control on the alignment members, it is possible to realize accurate binding processing using the second alignment member.

Although the embodiment of the present disclosure has been described above, the scope of the present disclosure is not limited thereto, and various modifications are added without departing from the spirit of the disclosure so as to be able to be practiced.

The present disclosure can be utilized for an image forming system that performs binding processing on a sheet bundle in which sheets supplied from an image forming apparatus are stacked.

What is claimed is:

1. A sheet post-processing device comprising:

a stacking tray which stacks sheets conveyed;

an alignment member which aligns a sheet bundle formed with the sheets stacked on the stacking tray; and a stapler which performs binding processing on a rear end of the sheet bundle in a conveying direction, wherein the stapler includes:

a first stapler which moves along the rear end of the sheet bundle and performs the binding processing on a plurality of positions at the rear end of the sheet bundle aligned with the alignment member in a first stacking position on the stacking tray; and a second stapler which is fixed outside a range of the movement of the first stapler on one side in a sheet width direction along the rear end of the sheet bundle and which performs, at one part of an end portion of the rear end on the one side, binding processing different from the first stapler on the sheet bundle moved with the alignment member on the stacking tray from the first stacking position to a second stacking position shifted from the first stacking position to the one side, and the alignment member includes:

a first alignment member and a second alignment member which slide independently of each other in the sheet width direction with respect to the stacking tray and which sandwich the sheet bundle in the sheet width direction so as to align the sheet bundle in the first stacking position; and a third alignment member which is fixed to a position corresponding to the second stapler such that the second alignment member can be passed through the third alignment member and which sandwiches and aligns the sheet bundle stacked in the second stacking position in the sheet width direction together with the first alignment member in a state where the second alignment member passes through the third alignment member.

2. The sheet post-processing device according to claim 1, wherein when the sheet bundle is bound with the first stapler, the second alignment member is located between the first alignment member and the third alignment member in the sheet width direction whereas when the sheet bundle is bound with the second stapler, the second alignment member is located in a same position as the third alignment member in the sheet width direction or is located outside the third alignment member in the sheet width direction.

3. The sheet post-processing device according to claim 2, wherein the second alignment member and the third alignment member respectively include a first alignment surface and a second alignment surface which make contact with the sheet bundle, and one of the first alignment surface and the second alignment surface includes an opening through which the other of the first alignment surface and the second alignment surface can be passed when the second alignment member is moved in the sheet width direction.

4. The sheet post-processing device according to claim 1, wherein the third alignment member is fixed to the second stapler.

5. The sheet post-processing device according to claim 1, further comprising:

a side plate which is part of a frame that holds the stacking tray and which is extended along a conveying direction perpendicular to the sheet width direction, wherein the side plate includes an opening through which the second alignment member can be passed when the second alignment member is moved in the sheet width direction, and also serves as the third alignment member.

6. The sheet post-processing device according to claim 4, further comprising:

an adjustment mechanism that adjusts, in the sheet width direction, a position in which the third alignment member is fixed to the second stapler.

7. The sheet post-processing device according to claim 5, further comprising:

an adjustment mechanism that adjusts, in the sheet width direction, a position in which the third alignment member is fixed to the second stapler.

8. The sheet post-processing device according to claim 1, wherein a maximum thickness of the second sheet bundle on which the binding processing can be performed with the second stapler is smaller than a maximum thickness of the first sheet bundle on which the binding processing can be performed with the first stapler.

9. The sheet post-processing device according to claim 1, wherein the first stapler is a stapler that binds with a needle, and the second stapler is a needle-free stapler without using a needle.

10. An image forming system comprising:

an image forming apparatus which forms an image on a sheet; and the sheet post-processing device according to claim 1 which performs predetermined post-processing on the sheet supplied from the image forming apparatus.

* * * * *